United States Patent [19]

Ando et al.

[11] Patent Number: 5,051,062

[45] **Date of Patent: * Sep. 24, 1991**

[54] RADIAL FLOW TURBINE ROTOR

[75] Inventors: Akio Ando, Kawasaki; Masae Nakanishi, Chigasaki; Syozi Okada, Yokohama; Koichi Inoue, Tokyo, all of Japan

[73] Assignee: Tokyo Shibaura Denki Kabushiki Kaisha, Japan

[ * ] Notice: The portion of the term of this patent subsequent to Jun. 24, 2004 has been disclaimed.

[21] Appl. No.: 425,998

[22] Filed: Sep. 28, 1982

[30] Foreign Application Priority Data

Nov. 25, 1981 [JP] Japan ..... 56-187839

[51] Int. Cl.[5] ..... F01D 5/28

[52] U.S. Cl. ..... 416/241 B; 416/188

[58] Field of Search ..... 416/188, 241 B, 244 A, 416/183

[56] References Cited

U.S. PATENT DOCUMENTS

| | | | |
|---|---|---|---|
| 4,011,295 | 3/1977 | Tree et al. | 416/241 B |
| 4,076,456 | 2/9178 | Tree et al. | 416/241 B |
| 4,123,199 | 10/1978 | Shimizu et al. | 416/241 B |
| 4,125,344 | 11/1978 | Tiefenbacher | 416/241 B |
| 4,176,519 | 12/1979 | Kronogard | 416/241 B |
| 4,272,954 | 6/1981 | Kronogard | 416/241 B |
| 4,279,576 | 7/1981 | Okano et al. | 416/241 B |
| 4,408,959 | 10/1983 | Long et al. | 416/241 B |
| 4,653,976 | 3/1987 | Blair et al. | 416/183 |

FOREIGN PATENT DOCUMENTS

| | | | |
|---|---|---|---|
| 548479 | 6/1956 | Belgium | 416/183 |
| 492190 | 3/1954 | Italy | 416/183 |
| 00652 | 8/1979 | PCT Int'l Appl. | 416/188 |
| 342035 | 12/1959 | Switzerland . | |
| 47910 | 10/1979 | U.S.S.R. | 416/188 |
| 594537 | 11/1947 | United Kingdom | 416/183 |

OTHER PUBLICATIONS

Keramische Bauteile für Fahrzeug-Gasturbinen 687 Mofortechnische Zeitschfft; vol. 39, No. 10 (1978,10).

*Primary Examiner*—John T. Kwon

*Attorney, Agent, or Firm*—Cushman, Darby & Cushman

[57] ABSTRACT

A radial flow turbine rotor comprises a trunconical shaft and a plurality of blades provided on the periphery of the shaft and inclined to the axis of the shaft. The shaft and the blades are integrally formed of ceramics. The profile of the cross section of each blade, taken along a line perpendicular to the axis of the shaft, is straight between the tip and base of the blade. The tip of each blade is 1.2 to 2.0 mm thick, and each blade grows thicker from the tip toward the base.

8 Claims, 1 Drawing Sheet

RADIAL FLOW TURBINE ROTOR

BACKGROUND OF THE INVENTION

This invention relates to a radial flow turbine rotor for use in a supercharger or the like which uses a high temperature exhaust gas from an internal combustion engine as drive medium.

An exhaust gas supercharger is known which is used in an internal combustion engine to increase the density of air supplied for combustion and to raise the effective pressure of combustion gas. Most superchargers have a radial flow turbine rotor in a combustion exhaust gas passage. An ordinary radial flow turbine rotor comprises a shaft and precision-cast, heat-resistant steel blades welded to the periphery of the shaft. The maximum temperature that the radial flow turbine rotor withstands is about 650° to 750° C. The rotor is rotated at about 100,000 rpm, at most.

The lower portions of the blades which are welded to the shaft are likely to break when a high vibratory stress is applied on them as the rotor spins at a high speed. With the supercharger it is taken in a high temperature, high pressure exhaust gas, to rotate the radial flow turbine rotor at a higher speed and to reduce the stress acting on the blades as much as possible. To this end, the radial flow turbine rotor must be made of material which is light, mechanically strong and resistant to heat. The conventional heat-resistant steel is not satisfactory from this standpoint.

Recently ceramic turbine rotors have been developed. For example, a curved blade rotor made of ceramic material is shown at pages 888–891 of "CERAMICS FOR HIGH PERFORMANCE APPLICATIONS-II" published in 1978 by Brook Hill Publishing Company. The above-mentioned curved blade rotor was made by AME Ltd. in reaction bonded silicon nitride. The main object of making ceramic curved blade rotor is to replace expensive nickel alloys by cheaper, non-strategic materials and to operate the turbine at high temperatures. However, it has been found to be necessary to improve the design of the rotor in making a curved blade rotor of ceramic material.

SUMMARY OF THE INVENTION

An object of the invention is to provide a radial flow turbine rotor which is so designed to be easily made of ceramics and be easily removed from a mold and which has blades of a large mechanical strength.

The radial flow turbine rotor according to the invention comprises a shaft and blades which are integrally formed of sintered ceramics. The cross section of each blade, taken along a line perpendicular to the axis of the shaft, is a narrow trapezoid, the center line of which passes the axis of the shaft. The tip of each blade is 1.2 to 2.0 mm thick.

DETAILED DESCRIPTION OF THE PREFERRED EMBODIMENT

Figure 1:
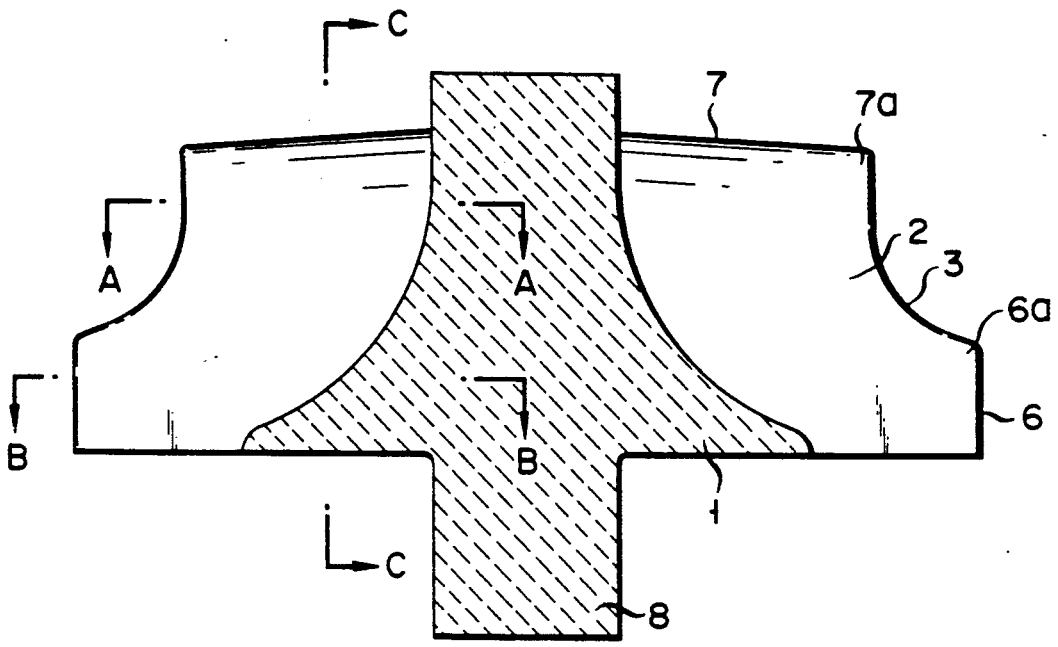
FIG. 1 is a longitudinal sectional view of a radial flow turbine rotor according to the invention.
Figure 2A:
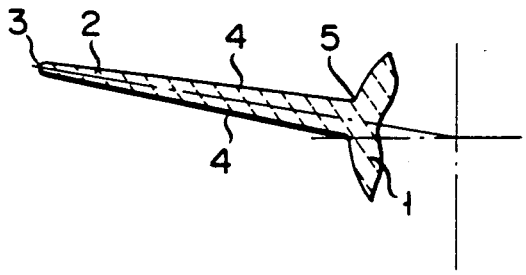
FIG. 2A is a sectional view taken along line A—A in FIG. 1.
Figure 2C:
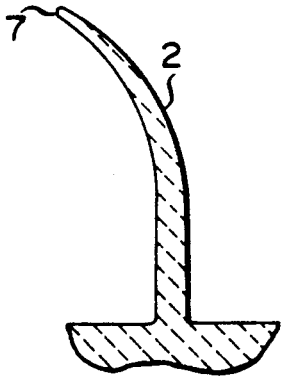
FIG. 2C is a sectional view taken along line C—C in FIG. 1.
Figure 2B:
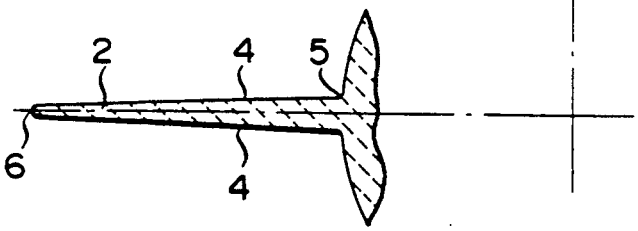
FIG. 2B is a sectional view taken along line B—B in FIG. 1.

An embodiment of the present invention will be described with reference to the accompanying drawings. FIG. 1 is a longitudinal sectional view of the embodiment, a radial flow turbine rotor. The turbine rotor comprises a trunconical shaft 1 and a plurality of blades 2 integrally formed with the shaft 1 and inclined to the axis of the shaft 1. FIG. 2A is a sectional view of each blade 1, taken along line A—A in FIG. 1 which is perpendicular to the axis of the shaft 1, and FIG. 2B is a sectional view of the blade 2, taken along line B—B in FIG. 1 which is perpendicular to the axis of the shaft 1. FIG. 2C is a sectional view of the blade, taken along line C—C in FIG. 1 which is parallel to the axis of the shaft 1. The center line of the cross section of each blade 2 passes the axis of the shaft 1. The profile of the cross section between the tip 3 (or 6) and the base 5, i.e. sides 4, is straight. Each blade 2 grows thicker from the tip 3 (or 6) toward the base 5. The tip 3 (or 6) is rounded, and its radius is about 0.5 to 1.0 mm. The tip 3 (or 6) of the blade 2 is about 1.2 to 2.0 mm thick, and thicker than those of the blades of a known radial flow turbine rotor. The blades 2 are mechanically stronger than those of the known rotor. The root radius of the base 5 is about 0.5 to 2.0 mm so that the blade will not be broken at the base 5 due to concentrated stress applied to the base 5. The sides 4 of the cross section of the blade 2 is inclined at about 0.5° to 3.0° to the center line of the cross section.

The shaft 1 and the blades 2 are integrally formed of ceramics by injection molding. The ceramics used may be a nitride such as $Si_3N_4$, AlN or TiN, an oxinitride such as $Si_2ON_2$ or SiAlON, a carbide such as SiC, $B_4C$, TiC and ZrC, a carbonitride such as $Si_3N_4$-SiC, or an oxide such as $Al_2O_3$, $ZrO_2$ or $MgAlO_2$. One of these material is injected into a mold, and the resulting molding is sintered. The blades 2 are ground so that their surfaces 3 conform to the inner surface of a casing (not shown), thereby to prevent an exhaust gas leak. The inlet edge 6 and output edge 7 of each blade 2 have corners 6*a* and 7*a* which are curved with a radius of about 0.1 to 5 mm to alleviate stress concentration at the corners 6*a* and 7*a*. If the radius of the curved corners 6*a* and 7*a* is less than 0.1 mm, stress concentration will not be alleviated. On the other hand, if it exceeds 5 mm, the exhaust gas will leak at the corners 6*a* and 7*a* so much to reduce the turbine efficiency. The shaft 1 is connected to a shaft 8.

Being a ceramic sintered body, the radial flow turbine rotor is light and has a large mechanical strength under a high temperature. Since the tip of each blade 2 is relatively thick and since the tip and base of each blade 2 are rounded, there is no risk that the blade 2 is broken when exerted with vibratory stress and rotational stress. Moreover, since the center line of the cross section of each blade 2 passes the axis of the shaft 1 and since the profile of the cross section between the tip and base is straight and inclined to the center line, the mold used in injection molding the rotor is simple in design. For the same reason, removing the molding from the mold can be easily done and extremely high-yield manufacture can be achieved.

Now, a specific example of the method of manufacture according to the invention will be described. A powder mixture consisting of 84% by weight of silicon nitride, 6% by weight of yttrium oxide and 10% by weight of aluminum oxide, the mean particle size thereof being 1.1, 1.2 and 0.5 microns respectively, was used. For the binder a thermoplastic organic material was used. The proportion of the organic binder should be as small as possible for it must be removed in the subsequent step. Generally, the volume ratio of the ceramic material to the organic binder ranges from about 70:30 to 50:50. In this example, it was set at 60:40. The ceramic material and binder were kneaded together while heating the system to a temperature of about 150° C. at which time the binder was fused. The paste thus obtained was used for injection molding with an injection pressure of about 500 kg/cm$^2$. The injection pressure desirably ranges from about 50 to 1,000 kg/cm$^2$. After the injection molding the molding was gradually heated to remove the binder through decomposition and evaporation. At this time, deformation of the molding and formation of cracks in the molding are prone, if the rate of temperature rise is low. For this reason, it is desirable to raise the temperature to about 500° to 1,200° C. at a rate of about 0.5° to 20° C./hr. In this example, the heating was done at a rate of about 5° C./hr. to raise the temperature to about 800° C. After the binder had been completely removed, the sintering was done. The sintering is desirably done by heating the molding in an inert gas such as nitrogen at a temperature of about 1,650° to 1,800° C. to prevent oxidation. In this example, the sintering was done by holding the molding in a nitrogen gas at about 1,750° C. for four hours. After sintering, the blade edges which are in contact with the casing were ground with a #200 diamond grindstone to obtain the product. The grindstone usually has a grain size ranging from #100 to #600.

The specific gravity and the liner thermal expansion coefficient of the ceramic materials obtained were 3.20 g/cc and $3.1\times10^{-6}$/°C. respectively. The flexural strengths were 75 kg/mm$^2$ at room temperature, 75 kg/mm$^2$ at 700° C. and 71 kg/mm$^2$ at 1000° C.

With this radial flow turbine rotor, no blade was broken during use.

What we claim is:

1. A radial flow turbine rotor made of ceramics, comprising:

a trunconical shaft; and a plurality of blades provided on the periphery of the shaft and inclined to the axis of the shaft, the center line of the cross section of each blade, taken along a line perpendicular to the axis of the shaft, passing the axis of the shaft, the profile of the cross section between the tip and base of the blade being straight, the tip of the blade being 1.2 to 2.0 mm thick, and the blade growing thicker from the tip toward the base, wherein the root radius of the base of each blade is 0.5 mm to 2.0 mm and wherein the center line of the cross section of each blade are inclined at 0.5° to 3.0° to the line perpendicular to the axis of the shaft.

2. A radial flow turbine rotor according to claim 1, wherein the tip of each blade is rounded with a radius of 0.5 to 1.0 mm.

3. A radial flow turbine rotor according to claim 1 or 2, wherein the inlet edge and outlet edge of each blade have a corner curved with a radius of 0.1 to 5 mm.

4. A radial flow turbine rotor according to claim 1 or 2, wherein said turnconical shaft and said blades are integrally formed by injection molding.

5. A radial flow turbine rotor according to claim 1 or 2, which is sintered by furnace sintering.

6. A radial flow turbine rotor according to claim 1 or 2, which is made of silicon nitride.

7. A radial flow turbine rotor according to claim 1 or 2, which is made of silicon carbide.

8. A radial flow turbine rotor according to claim 1 or 2, which is made of silicon aluminum oxynitride.

* * * * *